US007076982B2

(12) United States Patent
Coop

(10) Patent No.: US 7,076,982 B2
(45) Date of Patent: Jul. 18, 2006

(54) CONCENTRIC BORE BEND DIE AND CLAMP INSERT ASSEMBLY

(75) Inventor: Jeffrey W. Coop, Brea, CA (US)

(73) Assignee: Jeffrey & Connie Coop, LLC, Brea, CA (US)

( * ) Notice: Subject to any disclaimer, the term of this patent is extended or adjusted under 35 U.S.C. 154(b) by 243 days.

(21) Appl. No.: 10/755,096

(22) Filed: Jan. 9, 2004

(65) Prior Publication Data

US 2005/0150268 A1 Jul. 14, 2005

(51) Int. Cl.
*B21D 7/04* (2006.01)

(52) U.S. Cl. ..... 72/149; 72/157

(58) Field of Classification Search ..... 72/149, 72/150, 159, 155, 157, 158, 369
See application file for complete search history.

(56) References Cited

U.S. PATENT DOCUMENTS

| | | | | | |
|---|---|---|---|---|---|
| 4,009,601 | A | | 3/1977 | Shimizu | 72/369 |
| 4,137,743 | A | * | 2/1979 | Schwarze | 72/150 |
| 4,765,168 | A | | 8/1988 | Stange et al. | 72/159 |
| 4,888,971 | A | * | 12/1989 | Schwarze | 72/157 |
| 4,899,567 | A | * | 2/1990 | Lenglet et al. | 72/159 |
| 5,142,895 | A | | 9/1992 | Schuchert | 72/150 |
| 5,315,852 | A | | 5/1994 | Talley et al. | 72/149 |
| 5,481,891 | A | | 1/1996 | Sabine | 72/24 |
| 5,819,574 | A | | 10/1998 | Yogo | 72/155 |
| 5,927,124 | A | * | 7/1999 | Webster | 72/131 |
| 6,155,091 | A | | 12/2000 | Hayes et al. | 72/150 |

* cited by examiner

*Primary Examiner*—Derris H. Banks
*Assistant Examiner*—Teresa M Bonk
(74) *Attorney, Agent, or Firm*—Greenberg Traurig LLP; Bradley D. Blanche

(57) ABSTRACT

A concentric bore bend die and clamp insert assembly including a bend die and a clamp insert positioned within a recess formed in the bend die in a tube clamping area of the bend die. The clamp insert includes a curved portion matingly received within a correspondingly shaped curved bore in the recess, such that the curved portion extends between a tube groove in the insert and the curved bore. The curved portion of the clamp insert and the curved bore are radially concentric in order to evenly disperse clamping pressures exerted on the clamp insert in all radial directions across the curved portion of the clamp insert to the curved bore. The clamp insert further includes a non-circular portion that is matingly received within a correspondingly shaped non-circular region of the recess in order to resist rotational movement of the clamp insert with respect to the bend die.

32 Claims, 5 Drawing Sheets

CONCENTRIC BORE BEND DIE AND CLAMP INSERT ASSEMBLY

BACKGROUND OF THE INVENTION

1. Technical Field

The subject invention relates generally to the field of tube bending and, more particularly, to a novel concentric bore bend die and clamp insert used in a tube bending apparatus.

2. Description of Related Art

The technique of rotary draw tube bending derives its name from the concept of a tube or pipe being clamped, held and rotated around a bend die. During the process, the tube is pulled or drawn forward. As illustrated in FIG. 1, the minimum tools or components required in an apparatus for performing rotary draw tube bending are a clamp die 10, a bend die 12, and a pressure die 14. The bend die 12 is mounted on the center line of rotation of the tube bending apparatus, and the bend die 12 includes a shaped working area and a clamping area 16 with a tube groove extending through both areas. The clamp die 10 is situated opposite to the clamping area 16 on the bend die 12 and is positioned to hold a tube 18 in place against the clamping area 16 during the bending process as the clamp die 10 and the bend die 12 rotate in conjunction along a rotational direction 20. As the bend die 12 is rotated, it pulls the tube 18 to be bent around the bend die 12. The center line radius of the tube 18 being bent is determined by the diameter of the bend die 12. The function of the pressure die 14 is to hold the tube 18 against the bend die 12 and hold back reaction forces during the bending process to create the bend. The bending occurs within a narrow zone just prior to and slightly following the point where the pressure die 14 is tangent to the bend die 12. There are generally two types of pressure dies 14, the static type that remain in a fixed position during the bending process, and the tracking type that move with the material as it is wrapped around the bend die 12.

A rotary draw tube bending apparatus may also include other optional components, such as a wiper die 22 and/or a mandrel (not shown). A wiper die 22 is situated directly opposite to the pressure die 14 in order to prevent the tube 18 from distorting during the bending process. The wiper die 22 is manufactured and fitted to conform with the bend die 12 tube groove and the center line radius of the bend die 12. A mandrel is a component positioned to support the inner diameter of the tube 18 to be bent, where the mandrel also provides a surface to control metal flow in the bend tangent area of the part being bent. The mandrel basically serves to maintain a desired inner diameter of the tube 18 and to keep the tube 18 from flattening out during the bending process. Once the bending procedure is completed, the clamp die 10 and pressure die 14 are returned to their open position, and the bent tube is either moved to the next bend position or removed from the rotary draw tube bending apparatus.

The pressures exerted by the clamp die 10 through the tube 18 on the clamping area 16 of the bend die 12 during the bending process can lead to material failure of the bend die 12 and/or cause excessive wear to occur in the clamping area 16. In order to extend the life of the bend die 12 and to minimize the costs associated with replacing expensive bend die tooling, there have been attempts to position clamp inserts in the clamping area 16 of the bend die 12. Previous clamp insert designs have involved cutting a rectangular cutout region into the clamping area 16 of the bend die 12 and fitting a respectively shaped clamp insert into the rectangular cutout region.

The choice of material selected for constructing bend dies and clamp inserts have presented tool designers with conflicting considerations. Risk of tool failure can occur either i) by breakage if the material is too hard or ii) by rapid wear if the material is too soft. Due to stresses radiating through the clamp insert from the clamped bend tube 18 during the bending process, it has been necessary to make the traditional rectangular clamp inserts to possess a sufficient thickness so as to avoid breakage. Thus, the length of the clamp insert has traditionally been limited by there being a lack of available back up support by the bend die 12 to enable extension of the cutout region and, in turn, allow the clamp insert to extend all the way to tangent of the rotational axis of the bend die 12. These strength limitations further extend to the bend die 12, which must also maintain sufficient thickness on the sides of the rectangular cutout region so as to avoid material failure, breakage, and deflection. Further, there are limitations in the manners in which the clamp insert has traditionally been attached to the bend die 12, which has also led to material failure of the bend die 12.

SUMMARY

The following is a summary of various aspects and advantages realizable according to various embodiments of the concentric bore bend die and clamp insert assembly according to the present invention. It is provided as an introduction to assist those skilled in the art to more rapidly assimilate the detailed discussion of the invention that ensues and does not and is not intended in any way to limit the scope of the claims that are appended hereto.

The various embodiments described below relate to a concentric bore bend die and clamp insert assembly for use in rotary tube bending procedures. The concentric bore bend die and clamp insert assembly includes a bend die having a clamp insert positioned within a recess formed in the bend die in a clamping area of the bend die. A tube groove for receiving a tube to be bent during a tube bending process extends through both the bend die and the clamp insert. The clamp insert includes a curved portion that is matingly received within a correspondingly shaped curved bore in the recess, such that the curved portion extends along a length of the tube groove in between the tube groove and the curved bore. The curved portion of the clamp insert and the curved bore are radially concentric in order to evenly disperse clamping pressures exerted on the clamp insert in all radial directions across the curved portion of the clamp insert to the curved bore. The clamp insert further includes a non-circular portion that is matingly received within a correspondingly shaped non-circular region of the recess in order to resist rotational movement of the clamp insert with respect to the bend die.

BRIEF DESCRIPTION OF THE DRAWINGS

The features of the present invention, which are believed to be novel, are set forth with particularity in the appended claims. The present invention, both as to its organization and manner of operation, together with further advantages, may best be understood by reference to the following description, taken in conjunction with the accompanying drawings in which the reference numerals designate like parts throughout the figures thereof and wherein:

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein specifically to provide a concentric bore bend die and clamp insert assembly.

Figure 1:
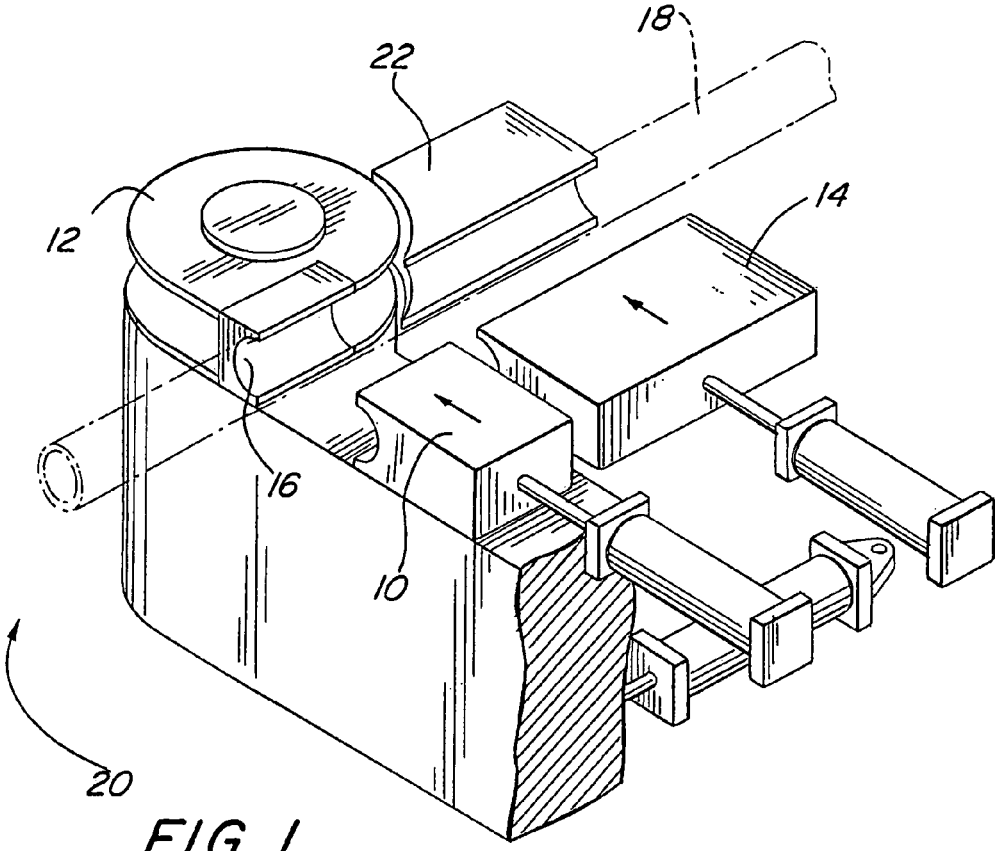
FIG. 1 PRIOR ART
FIG. 1 shows a conventional rotary tube bending apparatus.
Figure 2:
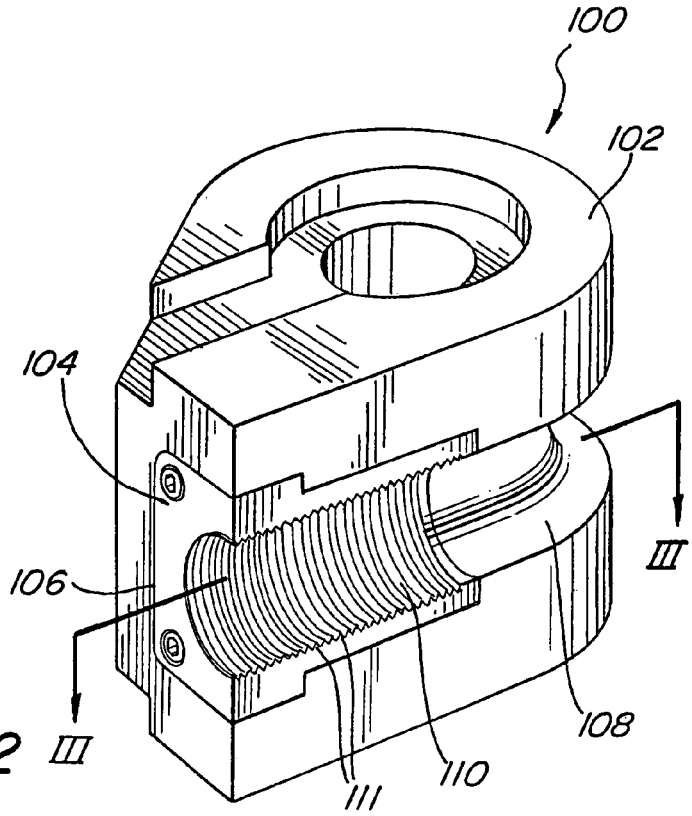
FIG. 2 shows a perspective view of a preferred embodiment of the concentric bend die and clamp insert assembly.
Figure 3:
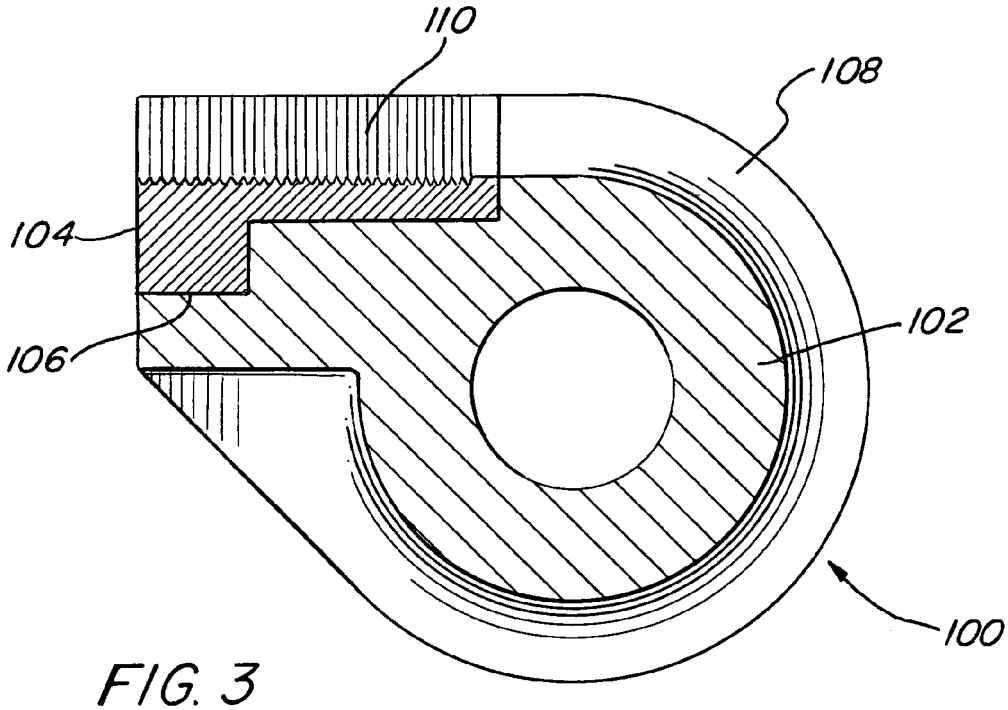
FIG. 3 shows a cross-sectional view of the concentric bend die and clamp insert assembly of FIG. 2 taken generally along line III—III.

Referring to FIGS. 2 and 3, a concentric bend die and clamp insert assembly 100 formed in accordance with a preferred embodiment is illustrated. The concentric bend die and clamp insert assembly 100 is utilized in tube bending devices well known to those skilled in the art that require the use of a bend die to bend tubing, such as rotary draw tube bending devices. The concentric bend die and clamp insert assembly 100 will be described hereinafter as being utilized to bend tubing, but it is the intention of the inventor of the present invention that the concentric bend die and clamp insert assembly 100 can also be used to perform bending procedures on piping or other similarly shaped articles. Further, the concentric bore design of the bend die and clamp insert assembly 100 may be utilized in any type of bend die known to those skilled in the art, including but not limited to S-type, U-type, C-type, P-type, platform-type and CB-type bend dies.

The assembly 100 includes a bend die 102 and a clamp insert 104, wherein the clamp insert 104 is positioned within a recess 106 formed within the bend die 102 in an area of the bend die 102 where a tube to be bent would be clamped against the bend die 102 by a clamp die or the like. The clamp insert 104 is matingly received and attached to the bend die 102 within the recess 106. The recess 106 may be formed in the bend die 102 in any manner customary in the art of manufacturing tooling, such as by machining the recess 106 in the bend die 102 after its fabrication, by integrally forming the recess 106 simultaneously with the fabrication of the bend die 102, or by other suitable manufacturing processes. The bend die 102 and the clamp insert 104 include respective tube grooves 108, 110 for receiving a tube to be bent during a tube bending process. The tube grooves 108, 110 preferably possess substantially the same radii of curvature which are in alignment along a common axial direction when the clamp insert 106 is positioned within the recess 106. The tube groove 110 may further include a plurality of circumferential grooves 111 formed in parallel to one another in order to assist in gripping a tube which is positioned within the tube groove 110 and clamped against the clamp insert 104.

With further reference to FIGS. 4, 5A–5C, and 6A–6D, the various features of a preferred embodiment of the concentric bend die and clamp insert assembly 100 will be set forth in greater detail. The recess 106 in the bend die 102 includes a curved bore 112 as well as a non-circular region 114. Similarly, the clamp insert 104 includes a curved portion 116 and a non-circular portion 118 which are matingly received within the curved bore 112 and the non-circular region 114, respectively, of the recess 106. In order to provide this mating relationship between the clamp insert 104 and the bend die 102, the curved portion 116 of the clamp insert 104 preferably includes a curved outer surface 120 having substantially the same contour and the substantially the same radius of curvature as the curved surface of the curved bore 112, while the non-circular portion 118 of the clamp insert 104 preferably possesses substantially the same contour as that of the non-circular region 114 of the recess 106.

The curved bore 112 possesses a radius of curvature that is slightly larger than the radius of curvature of the tube groove 108 in order to allow the curved portion 116 of the clamp insert 104 to be accepted within the recess 106 while keeping the tube grooves 108, 110 in alignment. The curved portion 116 of the clamp insert 104 extends between the tube groove 110 on one side and the curved outer surface 120 on its other side, such that the curved portion 116 is preferably U-shaped or semi-circular in shape. In a preferred embodiment, the curved outer surface 120 of the curved portion 116 is radially concentric with the curved surface of the curved bore 112, such that the curved bore 112 will possess a semi-circular shape when the curved portion 116 of the clam insert 104 possesses the same. Various views of the bend die 102 and the clamp insert 104 are further illustrated, respectively, in FIGS. 5A–5C and 6A–6D.

In a preferred embodiment, in order to provide a substantially even clamping pressure distribution across the entire curved portion 116 of the clamp insert 104, the tube groove 110 and the curved surface 120 of the curved portion 116 may be formed with radii of curvature which are concentric. In this arrangement, the curved bore 112 also possesses a radius of curvature that is concentric with both the tube groove 110 and the curved surface 120 of the clamp insert 104. This forms the concentric bore arrangement between the curved bore 112 and the curved portion 116 of the clamp insert 104.

The curved shapes of the curved portion 116 of the clamp insert 104 and the curved bore 112 allow pressures exerted on the clamp insert 104 as a tube is clamped there against to be evenly dispersed in all radial directions across the curved portion 116 to the curved bore 112. For instance, when the curved portion 116 is formed as being semi-circular, the clamping pressure is dispersed across the curved portion 116 over 180 degrees. This pressure dispersal causes almost no deflection in the clamp insert 104, resulting in the clamping forces being more efficient. Further, this clamping pressure dispersal enables greater clamping pressures to be used during tube bending procedures.

By dispersing clamping pressures in a substantially uniform manner across the curved portion 116 of the clamp insert 104 and further by fully supporting and completely containing the curved surface 120 of the curved portion 116 within the recess 106 of the bend die 102, the clamp insert 104 may be formed of a thin, wear-resistant steel material or similar material. This design of the concentric bend die and clamp insert assembly 100 allows much thinner clamp insert 104 to be formed than conventional clamp inserts having rectangular shapes. Furthermore, the relatively thin design of the clamp insert 104 requires less material to be removed from the bend die 102 in the recess 106 for accommodating the clamp insert 104, resulting in a bend die 102 being structurally much stronger than conventional bend dies having rectangular cutout regions.

As shown in FIG. 4 and FIGS. 6A–6D, the clamp insert 104 further possesses a non-circular portion 118 formed adjacent to the curved portion 116. The non-circular portion 118 of the clamp insert 104 preferably possesses substantially the same contour as that of the non-circular region 114 of the recess 106 in order to allow the non-circular portion 118 to be matingly received within a correspondingly shaped non-circular region 114 of the recess 106. The non-circular shapes of the non-circular portion 118 and the non-circular region 114 assist in retaining the clamp insert 104 in place within the recess 106 and preventing the clamp insert 104 from rotating with respect to the bend die 102. In a preferred embodiment, the non-circular portion 118 of the clamp insert 104 and the non-circular region 114 of the recess 106 are both rectangular in shape. However, it is the intention of the inventor of the present invention that the non-circular portion 118 and the non-circular region 114 may possess any shapes which resist rotation of the clamp insert 104 with respect to the bend die 102 about a central axis of the tube groove 110. In describing these shapes as being non-circular, it is the intention of the inventor of the present invention for non-circular to refer to shapes which do not follow a curve extending along a substantially uniform radius of curvature.

Figure 4:
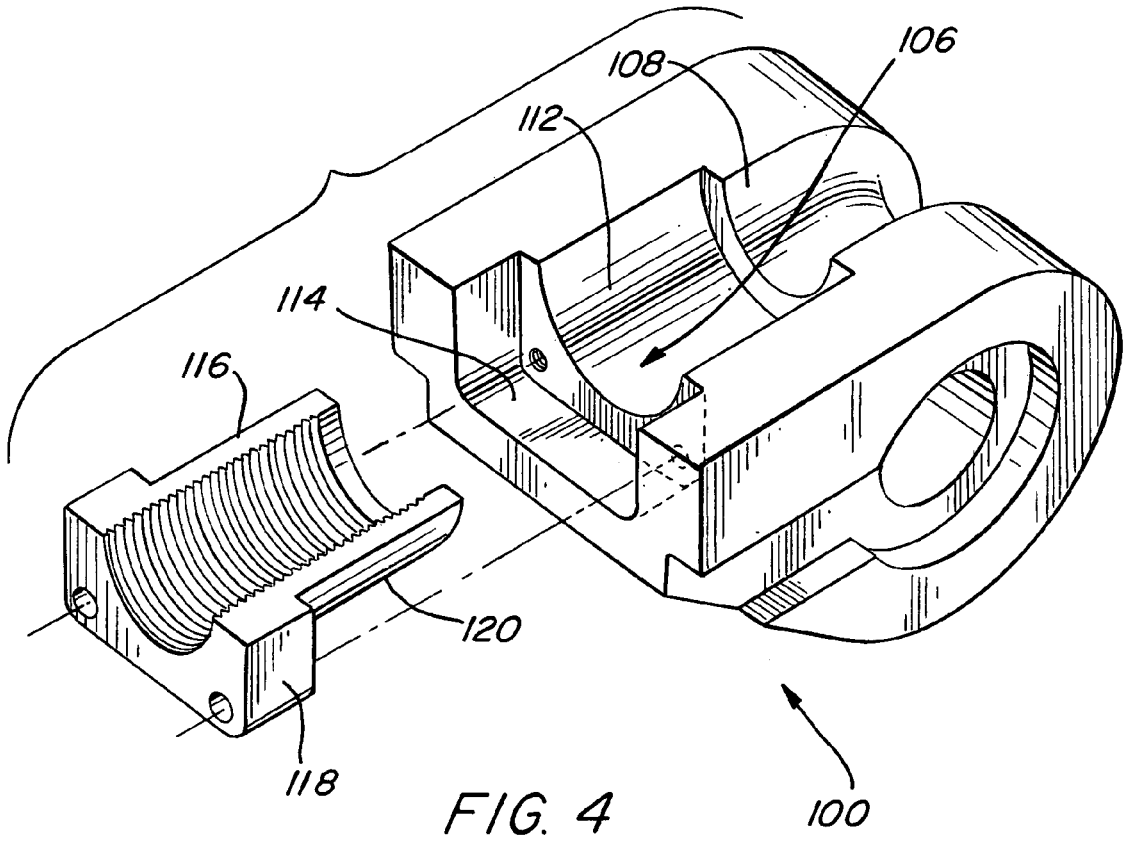
FIG. 4 is an exploded perspective view illustrating the separate components of the concentric bend die and clamp insert assembly of FIG. 2.
Figure 5A:
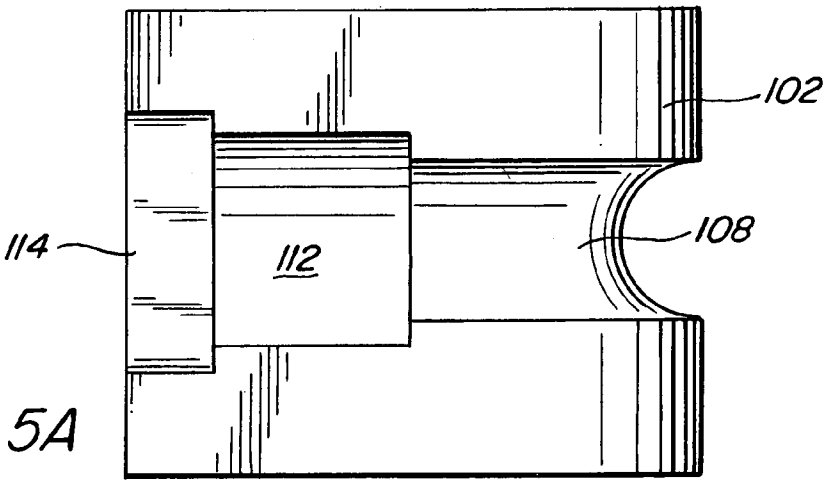
FIGS. 5A–5C are top, end and cross-sectional views, respectively, of a preferred embodiment of bend die of the concentric bore bend die and clamp insert.
Figure 5C:
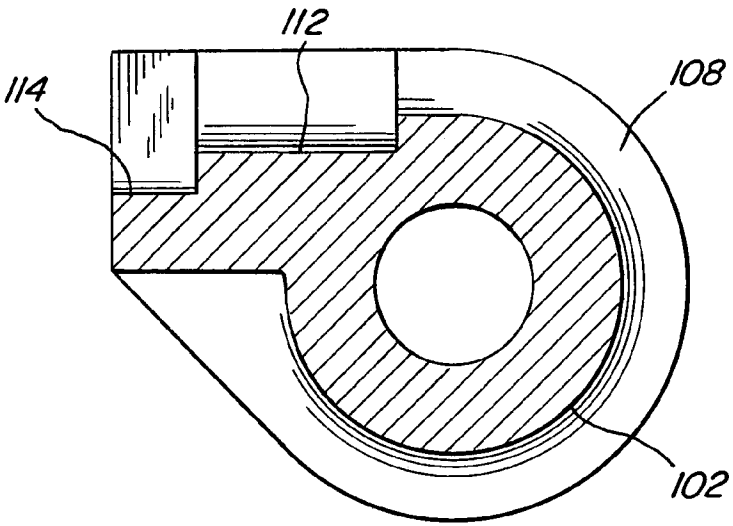
Figure 5B:
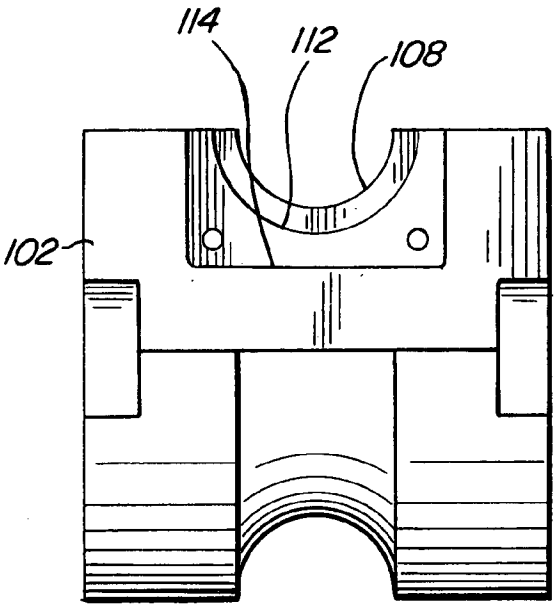
Figure 6A:
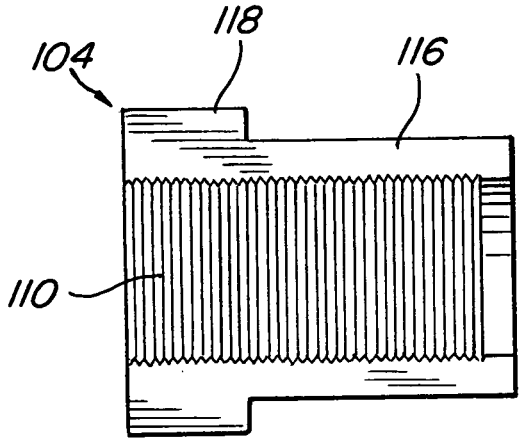
FIGS. 6A–6D are top, end, cross-sectional, and perspective views respectively, of a preferred embodiment of a clamp insert of the concentric bore bend die and clamp insert.
Figure 6B:
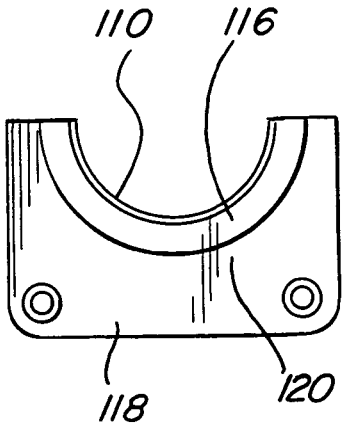
Figure 6C:
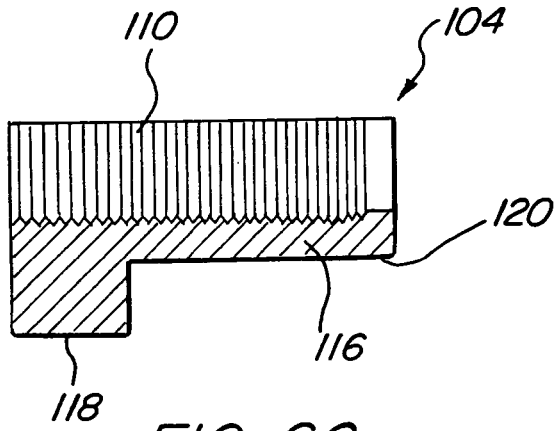
Figure 6D:
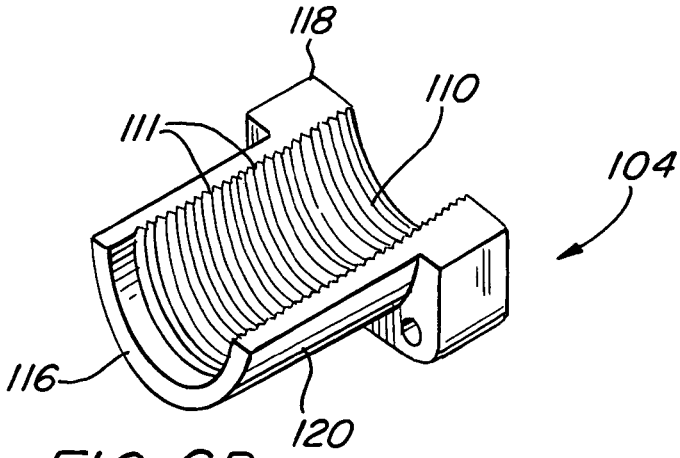

By forming the clamp insert 104 and the recess 106 to include non-circular portion 118 and non-circular region 114, respectively, perfect alignment between the clamp insert 104 and the bend die 102 can be achieved in a convenient and consistent manner by simply inserting the clamp insert 104 into the recess 106 as depicted in FIG. 4. Alignment between these components is critical in order to ensure that the tube grooves 108, 110 are properly aligned, where proper alignment of the tube grooves 108, 110 must be maintained to keep imperfections from being introduced into a tube as it is clamped against the clamp insert 104 and rotated about the bend die 102 during the tube bending procedure.

Figure 7:
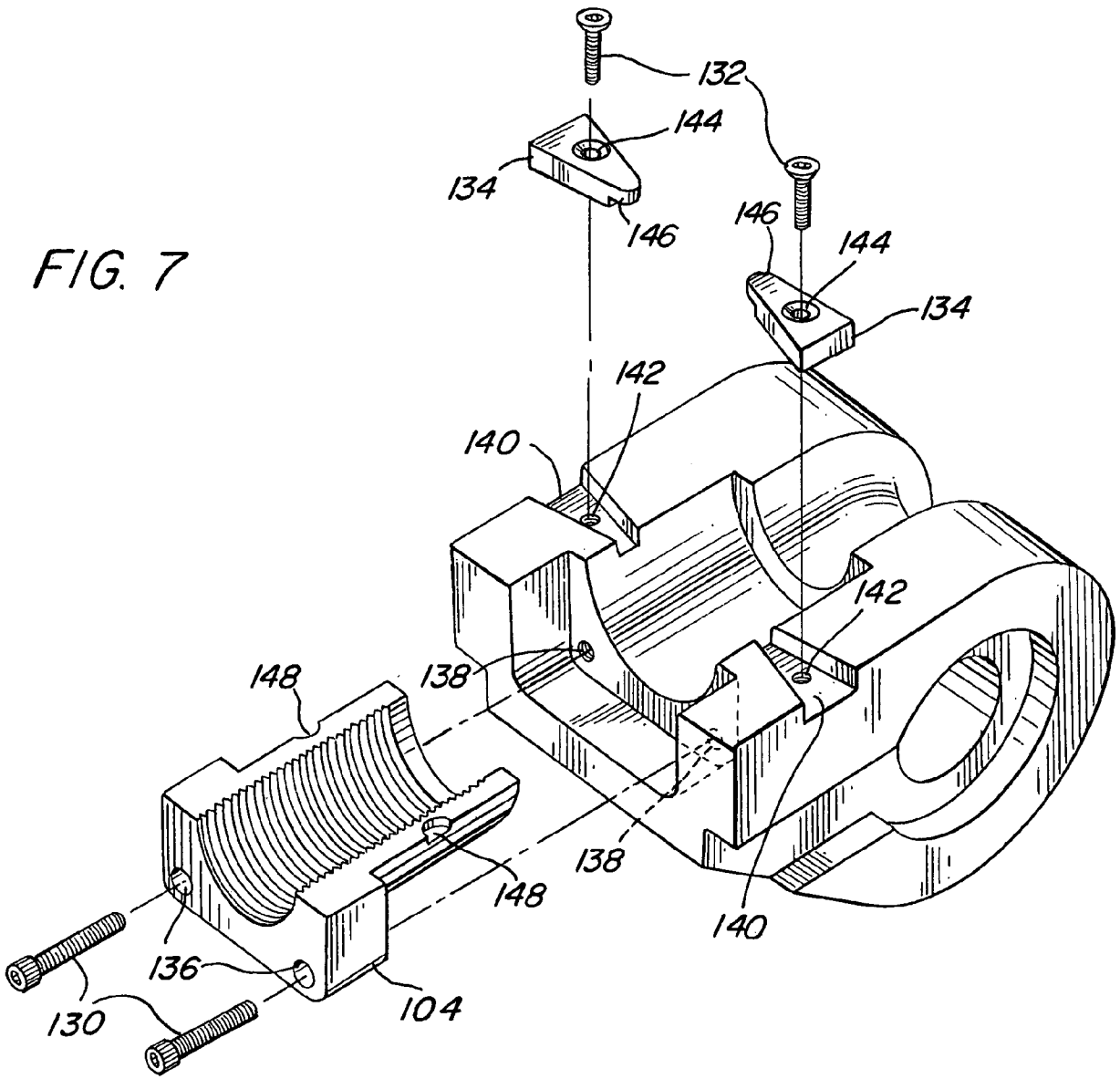
FIG. 7 is an exploded perspective view of another preferred embodiment of the concentric bend die and clamp insert assembly of the present invention.

The clamp insert 104 may be attached to the bend die 102 in any manner known to those skilled in the art for affixing inserts to tooling components, and the scope of the present invention is not intended to be limited to the various attachment embodiments specifically described hereafter. In a preferred embodiment, the clamp insert 104 is held in place within the recess 106 of the bend die using a plurality of bolts 130 as illustrated in FIG. 7. The clamp insert 104 includes a plurality of bores 136 extending through the non-circular portion 118 for respectively receiving bolts 130 there through, wherein the bolts 130 are further received within bores 138 formed within bend die 102 to retain the clamp insert 104 against the bend die 102. The design of the concentric bore bend die and clamp insert assembly 100 allows for complete containment and positive positioning of the clamp insert 104. As such, the clamp insert 104 requires only minimal applied holding forces to retain its position on the bend die 102, thus eliminating the attachment problems associated with conventional inserts for conventional bend dies.

In another preferred embodiment, a combination of bolts 130, 132 and clamps 134 are utilized to retain the clamp insert 104 against the bend die 102 in a plurality of geometric planes. In this arrangement, the bend die 102 includes a plurality of recesses 140 formed adjacent to recess 106 for respectively receiving a plurality of clamps 134, wherein each of the recesses 140 further include a bore 142 for receiving a bolt 132. The clamps 134 include apertures 144 for accommodating the passage of a bolt 132 there through, where the clamps 134 further include a lip 146 which is positioned over a portion 148 of the clamp insert 104. As the bolt 132 is inserted through the aperture 144 of the clamp 134 and into engagement with the bore 142, the force exerted by the bolt 132 on the clamp 134 is passed on through the lip 146 of the clamp 134 to portion 148 of the clamp insert 104 to retain the clamp insert 104 against the bend die 102. In an alternative preferred embodiment, the bolts 132 may be utilized to directly retain the clamp insert 104 to the bend die 102 without the use of the clamps 134 by extending the bolts 132 through additional openings in the clamp insert 104 into corresponding bores in the bend die 102. In these arrangements, the clamp insert 104 is thus retained against the bend die 102 in two geometric planes in this arrangement, wherein such geometric planes are preferably at right angles with respect to each other to provide the optimal results. This attachment of the components in the concentric bore bend die and clamp assembly 100 eliminates the weaknesses on the bend die 102 created by previously utilized clamp insert mountings, clamp insert recesses, center posts, and drive keys. The bores 138 and 142 may be formed with any desired surface characteristics, including but not limited to being formed to have a gripping surface, a textured surface, a threaded surface, a smooth surface, or any other surface characteristics that provide a desired engagement with bolts respectively received therein.

As can be seen from the foregoing, a concentric bore bend die and clamp insert assembly 100 formed in accordance with the present invention provides a tool assembly having a greater tool life by allowing tougher materials to be utilized for the bend die 102 for strength and a more wear resistant material to be utilized for the clamp insert 104. Moreover, the concentric relationship between the curved bore and the curved portion of a concentric bore bend die and clamp insert apparatus formed in accordance with the present invention allows greater clamping pressures to be used by evenly dispersing the clamping pressure over all radial directions of curved portion of the clamp insert. The concentric bore design of the bend die and clamp insert assembly 100 may be utilized in any types of bend die known to those skilled in art.

The different structures of the concentric bend die and clamp insert assembly of the present invention are described separately in each of the above embodiments. However, it is the full intention of the inventors of the present invention that the separate aspects of each embodiment described herein may be combined with the other embodiments described herein. Those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. A bend die and clamp insert assembly for a tube bending apparatus, comprising:

a bend die having a recess formed therein in an area of said bend die where a tube to be bent is clamped against said bend die, wherein at least a portion of said recess includes a curved bore having a curved surface; and a clamp insert attached to said bend die and received within said recess of said bend die, wherein said clamp insert includes a curved portion having a curved outer surface that matingly abuts said curved surface of said curved bore in said bend die.

2. The bend die and clamp insert assembly of claim 1, wherein said curved outer surface of said curved portion of said clamp insert and said curved surface of said curved bore in said bend die are radially concentric.

3. The bend die and clamp insert assembly of claim 2, wherein said curved portion of said clamp insert and said curved surface of said curved bore each possess generally semi-circular curvatures.

4. The bend die and clamp insert assembly of claim 1, wherein said bend die further includes a tube groove for receiving a tube to be bent, wherein said tube groove possesses a radius of curvature that is smaller than a radius of curvature of said curved surface of said curved bore.

5. The bend die and clamp insert assembly of claim 1, wherein said clamp insert further includes a tube groove for receiving a tube to be bent such that said tube groove of said clamp insert is in alignment with the tube groove of said bend die when said clamp insert is attached to said bend die, further wherein said curved portion of said clamp insert extends between said tube groove and said curved outer surface.

6. The bend die and clamp insert assembly of claim 5, wherein said tube groove of said clamp insert is radially concentric with said curved surface of said curved bore in said bend die.

7. The bend die and clamp insert assembly of claim 6, wherein said tube groove of said clamp insert, said curved outer surface of said curved portion of said clamp insert, and said curved surface of said curved bore in said bend die are all radially concentric.

8. The bend die and clamp insert assembly of claim 5, wherein said curved portion of said clamp insert is generally semi-circular in shape.

9. The bend die and clamp insert assembly of claim 8, wherein said curved portion of said clamp insert comprises a thin, wear-resistant steel material.

10. The bend die and clamp insert assembly of claim 5, wherein at least a portion of said tube groove of said clamp insert further includes a plurality of circumferential grooves formed in parallel to each other for assisting in gripping a tube to be inserted into said tube groove.

11. The bend die and clamp insert assembly of claim 1, wherein said recess of said bend die further comprises a non-circular region adjacent to said curved bore, further wherein said clamp insert further comprises a non-circular portion that is matingly received within said non-circular region of said recess of said bend die.

12. The bend die and clamp insert assembly of claim 11, wherein said mating relationship between said non-circular region of said recess and said non-circular portion of said clamp insert resists rotation of said clamp insert with respect to said bend die.

13. The bend die and clamp insert assembly of claim 11, wherein said non-circular region of said recess and said non-circular portion of said clamp insert are rectangular in shape.

14. The bend die and clamp insert assembly of claim 11, wherein said clamp die is attached to said bend die by attachment devices resisting movement in at least two geometric planes.

15. The bend die and clamp insert assembly of claim 14, wherein said bend die includes a plurality of bores extending in at least two geometric planes, wherein said clamp insert is attached to said bend die using a plurality of bolts which are respectively received in said plurality of bores.

16. The bend die and clamp insert assembly of claim 15, wherein said two geometric planes of said bores are at right angles with respect to each other.

17. A clamp insert for attachment to a bend die used in a tube bending apparatus, wherein said bend die includes a recess formed therein in an area of said bend die where a tube to be bent would be clamped against said bend die and wherein at least a portion of said recess includes a curved bore having a curved surface, said clamp insert comprising:

a curved portion having a curved outer surface that matingly abuts said curved surface of said curved bore in said bend die, wherein said clamp insert is attachable to said bend die and receivable within said recess of said bend die.

18. The clamp insert of claim 17, further comprising a tube groove for receiving a tube to be bent, wherein said curved portion of said clamp insert is formed between said tube groove and said curved outer surface.

19. The clamp insert of claim 18, wherein said tube groove and said curved outer surface of said curved portion are radially concentric.

20. The clamp insert of claim 19, wherein said curved portion of said clamp insert is generally semi-circular in shape.

21. The clamp insert of claim 19, wherein said curved portion of said clamp insert comprises a thin, wear-resistant steel material.

22. The clamp insert of claim 17, wherein said clamp insert further comprises a non-circular portion that is matingly receivable within a non-circular region formed in said recess of said bend die.

23. The clamp insert of claim 22, wherein said mating relationship between said non-circular region of said recess and said non-circular portion of said clamp insert resists rotation of said clamp insert with respect to said bend die.

24. The clamp insert of claim 22, wherein said non-circular region of said clamp insert is rectangular in shape.

25. A bend die for a tube bending apparatus, comprising:

a tube groove for receiving a tube to be bent; and a recess formed therein for receiving a clamp insert in an area of said bend die where a tube to be bent is clamped against said bend die, where at least a portion of said recess includes a curved bore having a curved surface, wherein said tube groove possesses a radius of curvature that is smaller than a radius of curvature of the curved bore.

26. The bend die of claim 25, wherein said radii of curvature of said tube groove and said curved bore are radially concentric.

27. The bend die of claim 25, wherein said curved bore possesses a generally semi-circular curvature.

28. The bend die of claim 25, wherein said recess of said bend die further comprises a non-circular region adjacent to said curved bore for matingly receiving a non-circular portion of the clamp insert.

29. The bend die of claim 28, wherein said mating relationship between said non-circular region of said recess and said non-circular portion of said clamp insert resists rotation of said clamp insert with respect to said bend die.

30. The bend die of claim 28, wherein said non-circular region of said recess is rectangular in shape.

31. The bend die of claim 25, further comprising a plurality of bores extending in at least two geometric planes, said plurality of bores capable of receiving a respective plurality of bolts for attaching the clamp insert to said bend die.

32. The bend die of claim 31, wherein said two geometric planes of said bores are at right angles with respect to each other.

* * * * *